United States Patent [19]

Ames et al.

[11] 4,007,619

[45] Feb. 15, 1977

[54] CONTAINER FOR AN EXTRUSION PRESS

[75] Inventors: Adolf Ames, Hilzingen; Alfred Wagner, Steisslingen, both of Germany

[73] Assignee: Swiss Aluminium Ltd., Neuhausen am Rheinfall, Switzerland

[22] Filed: Apr. 4, 1975

[21] Appl. No.: 564,997

[30] Foreign Application Priority Data

Apr. 11, 1974 Germany ..... 2417815

[52] U.S. Cl. ..... 72/272; 29/446

[51] Int. Cl.[2] ..... B27B 27/00; B23K 31/06

[58] Field of Search ..... 72/253, 271, 272, 357, 72/465, 466, 260; 29/446; 228/184; 207/15

[56] References Cited

UNITED STATES PATENTS

| | | | |
|---|---|---|---|
| 2,283,791 | 5/1942 | Clark | 72/272 |
| 2,960,221 | 11/1960 | Albers et al. | 72/272 |
| 3,089,591 | 5/1963 | Groos | 72/272 |
| 3,892,114 | 7/1975 | Taniguchi et al. | 72/272 |

FOREIGN PATENTS OR APPLICATIONS

| | | | |
|---|---|---|---|
| 895,100 | 1/1945 | France | 72/272 |
| 868,736 | 2/1953 | Germany | 72/272 |

OTHER PUBLICATIONS

Hanff, Alien Property Custodian Serial No. 362,833, filed Oct. 25, 1940, Published May 18, 1943.

*Primary Examiner*—C. W. Lanham
*Assistant Examiner*—D. M. Gurley
*Attorney, Agent, or Firm*—Ernest F. Marmorek

[57] ABSTRACT

A container for an extrusion press with a liner space which has its shape defined by at least one, if desirable several, component parts in which in the liner wall where the highest stresses arise there is provided at least one groove or similar recess. These grooves run approximately in the extrusion direction, and are filled and sealed with a weld which behaves elastically during extrusion. The intrusion of extruded metal into the gaps is thus prevented and a longer lifetime of the container is achieved.

8 Claims, 4 Drawing Figures

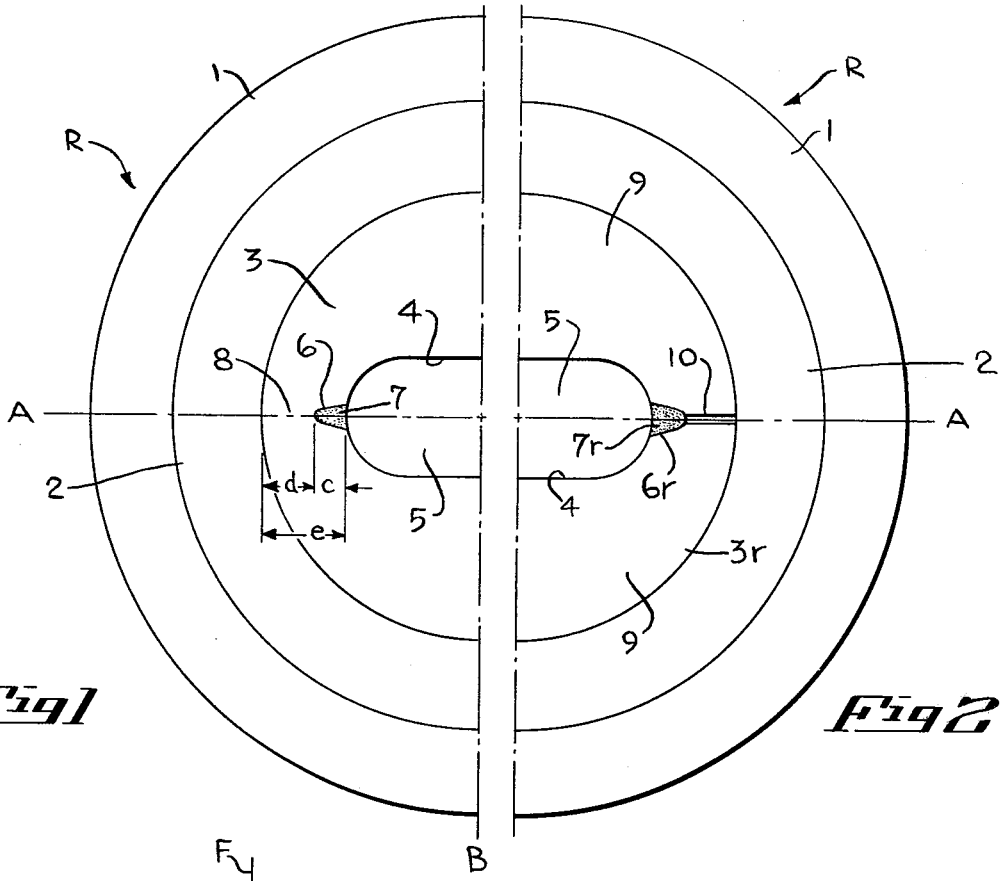
Fig 1
Fig 2
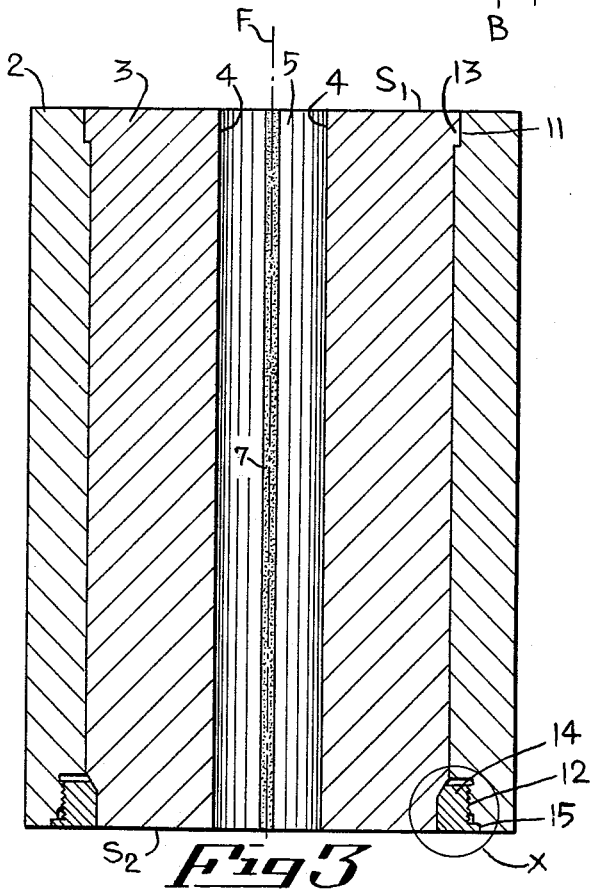
Fig 3
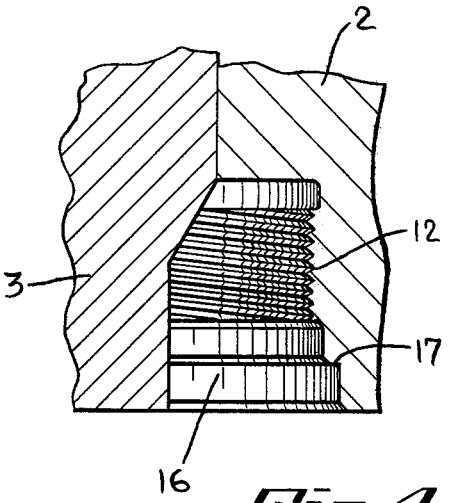
Fig 4

CONTAINER FOR AN EXTRUSION PRESS

The invention concerns an extrusion press container with a liner space which has its shape defined by at least one, if desirable several, component parts.

In the normal design of such extrusion containers with the cross section of the innermost space for the metal being extruded in the form of rectangle the liners usually fail prematurely as a result of cracks in the small side of the liner. This requires either frequent changing of the expensive liners or can in fact lead to complete fracture of the whole container. The result of such difficulties are expensive interruptions in production and delays in the supply of products.

The events described above agree with optical stress analyses on models which show for example the presence of high stress concentrations on the axis of symmetry of the semicircular small sides of the liner where fracture would occur.

Attempts have been made to overcome this problem by using liners made up of several parts which are held securely together by an encircling cylindrical part. Gaskets have been used to try to prevent dirt from entering the gaps between the liner parts. These gaskets should press against the liner wall under the influence of the pressure built up during extrusion. These changes however are completely ineffective, and are so, not simply because of the unreliability of the gaskets.

The aim of the inventor was to produce an extrusion container of the kind mentioned at the start whereby the known disadvantages would be avoided, to increase the lifetime of the device and to raise the assurance of continuity in production.

In order to achieve this the inventor had the idea to make at least one groove in the region of the highest stresses in the liner wall and running in the extrusion direction, and to close this up with weld metal which behaves elastically. According to a further feature of the invention — in a container with liner made of several parts and having gaps provided between the parts, running approximately radially to the centre of the liner — at least one of the gaps should extend in the direction of the centre to a groove or similar recesss which takes weld metal which fills the gap completely. Due to the elastic behaviour of the weld the described crack formation is prevented and also the stresses built up in the liner during extrusion are transmitted to the surrounding components, for example to an inner cylinder contained within an outer cylinder which contains both the inner cylinder and the liner.

It has been found particularly favorable with a liner space of elongated cross section if the groove — together with the elastic weld seam — runs along the small inside face of the liner space, preferably at the extremity on the slightly curved face. These points of extremity have to bear the highest stress concentration when the small side liner space is semicircular in shape.

If the liner is made up of several parts, to advantage of two shell-shaped halves, then these can be held together by welds and the gaps additionally sealed against intrusion by the metal being extruded.

Trials have shown that in particular two austenitic filler metals are very suitable in welding the container liner of the invention. These filler metals are denoted by the DIN specification X 12 Cr Ni 25 20 (less than about 0.15% carbon, less than about 1.5% silicon, about 1.0 to 2.5% manganese, about 24.0 to 27.5% chromium, about 19.5 to 22.0% nickel, and the remainder iron) and X 15 Cr Ni Mn 18 8 (less than 0.20% carbon, less than 1.5% silicon, about 5.5 to 7.5% manganese, about 17.5 to 20.5% chromium, about 7.5 to 9.5% nickel, and the remainder iron) the latter of which in particular offers good mechanical properties with respect to yield strength, tensile strength, necking and elongation.

The radial stresses are taken up in the main axis of the inner cylinder and in the outer cylinder of the device. Axial stresses must be transmitted from the liner to the inner cylinder either through a shrink-fit of these components or/and through anchoring at the ends of the container. In order to assist the assembly and promote confidence in use, in terms of the objectives, the liner is, in terms of the invention, fitted at one of the container into a shoulder-like recess in the inner or outer cylinder with a radially projecting collar and engaged securely in this by means of a threaded ring at the other end in a space defined by the liner and the inner cylinder in which the threaded ring fits tightly.

Further advantages, features and details of the invention are explained in the following description with the aid of preferred examples and drawings viz..

FIG. 1 is a partial end view of a container according to the invention;

FIG. 2 is a partial end view of another container according to the invention;

FIG. 3 is a sectional view of FIG. 1 along the line B; and

FIG. 4 is a portion of FIG. 3 on an enlarged scale.

The outer cylinder 1 of a container R for an extrusion press which is not shown, surrounds an inner cylinder 2 in which, as in FIG. 1, a one piece liner 3 is positioned. The inner wall 4 of the liner 3 outlines a liner space 5 of oblong cross section.

A V-shaped groove 6 is provided in the liner 3 in the long axis A and is filled with a weld 7, the length C of which is slightly smaller than the length d of the remaining section 8 of the thinnes part e of the wall of the liner 3. The remaining section 8, in particular when used in conjunction with a shrink-fit between liner 3 and inner cylinder 2, must be properly dimensioned.

The example according to FIG. 2 has a liner 3 r composed of two shell-like components 9 which form a gap 10 in the cross sectional axis A on each narrow side of the space 5. These gaps 10 open into a groove 6 *r* of U-shape in cross section which after fitting the components 9 together is filled with a weld 7 r or filler metal having the DIN specification X 15 Cr Ni Mn 18 8.

During extrusion the inner and outer cylinders 2 and 1 resp., of the container take on the forces emanating radially from the space 5. In the liner 3 made of one piece, the elastic behaviour of the weld 7 prevents cracking in the wall 4 in the direction of the axis A. If a crack should form in the remaining cross section 8, the weld 7 seals it against penetration of the metal being extruded.

Also in the case of the two-piece liner 3 r the weld 7 r prevents the penetration of extruded metal into the gap 10.

In order to ensure that the liner(s) 3, 9 does/do not shift in direction of the liner axis F, as shown in FIG. 3, there is provided at one end $S_1$ of the container R a band 13 which is part of the liner 3 and which fits into the shoulder-like ridge 11 in the inner cylinder 2 and at the other end $S_2$ there is provided a thread 12 (see area X). A threaded ring 14 with outer collar 15 is screwed into the space 16 between the liner 3 and the inner cylinder 2 until the outer collar 15 makes contact with a shoulder 17 in the space 16.

It has been found to be particularly advantageous in containers R made up of several components to use an inner cylinder 2 which holds the — in FIG. 2 mulitcomponent — liner 3 *r* together, and takes up the pressure which builds up during extrusion.

We claim:

1. A container for an extrusion press for use in an extrusion process, comprising:

a liner space having its shape defined by at least one liner wall;

said liner wall having at least one groove defined in a predetermined part thereof at which high stresses during the extrusion process are expected and extending in the direction of extrusion; and a weld joint disposed in said groove filling and sealing it;

said weld joint being elastic during the extrusion process.

2. The container as claimed in claim 1, wherein said liner space has an elongated cross-section and said groove is near a narrow side of said liner wall.

3. The container as claimed in claim 1, wherein said liner space has an elongated cross-section with rounded small sides and there are a plurality of said grooves near the extremities of said liner space.

4. The container as claimed in claim 1, wherein said weld joint is composed of the filler composed of less than about 0.15% carbon, less than about 1.5% silicon, about 1.0 to 2.5% manganese, about 24.0 to 27.5% chromium, about 19.5 to 22.0% nickel, and the remainder iron or less than 0.20% carbon, less than 1.5% silicon, about 5.5 to 7.5% manganese, about 17.5 to 20.5% chromium, about 7.5 to 9.5% nickel, and the remainder iron.

5. The container as claimed in claim 1, further comprising an inner cylinder surrounding said liner wall, whereby the pressure developing during the extrusion process is transmitted to said inner cylinder and an outer cylinder surrounding said inner cylinder.

6. The container as claimed in claim 5, wherein said liner wall has a radial projection defined at one end and said inner cylinder has a recess defined in it to engage said projection and further comprising connecting means connecting said liner wall and said inner cylinder in a space defined by them at the other end of said liner wall.

7. A container for an extrusion press for use in an extrusion process, comprising a multi component liner having gaps extending approximately radially towards the center of the space defined by the liner between its components, and a weld joint disposed in at least a portion of each of the gaps defined between the components of said liner, said weld joint being elastic during the extrusion process.

8. The container as claimed in claim 7, wherein said weld joint is composed of the filler metal composed of less than about 0.15% carbon, less than about 1.5% silicon, about 1.0 to 2.5% manganese, about 24.0 to 27.5% chromium, about 19.5 to 22.0% nickel, and the remainder iron or less than 0.20% carbon, less than 1.5% silicon, about 5.5 to 7.5% manganese, about 17.5 to 20.5% chromium, about 7.5 to 9.5% nickel, and the remainder iron.

* * * * *